US006829851B2

(12) United States Patent
Oross et al.

(10) Patent No.: US 6,829,851 B2
(45) Date of Patent: Dec. 14, 2004

(54) FOLDABLE LABEL DISPLAY SYSTEM

(75) Inventors: Glen A Oross, Corvallis, OR (US); Memphis Zhihong Yin, Corvallis, OR (US); Neal D Buchanan, Cheshire, OR (US); Robert P Bliven, Corvallis, OR (US)

(73) Assignee: Hewlett-Packard Development Company L.P., Houston, TX (US)

( * ) Notice: Subject to any disclaimer, the term of this patent is extended or adjusted under 35 U.S.C. 154(b) by 446 days.

(21) Appl. No.: 10/003,604

(22) Filed: Oct. 31, 2001

(65) Prior Publication Data

US 2003/0080922 A1 May 1, 2003

(51) Int. Cl.[7] ..... G09F 1/00

(52) U.S. Cl. ..... 40/124.06; 40/124.13; 40/672

(58) Field of Search ..... 40/124.06, 124.13, 40/638, 661.06, 661.08, 661.09, 672; 283/81

(56) References Cited

U.S. PATENT DOCUMENTS

| | | | | | |
|---|---|---|---|---|---|
| 1,910,476 | A | * | 5/1933 | Rulong | 40/661.06 |
| 3,726,030 | A | * | 4/1973 | Wilson | 40/638 |
| 4,784,408 | A | * | 11/1988 | Yasuda | 283/81 |
| 4,984,683 | A | * | 1/1991 | Eller | 40/661.06 |
| 2001/0036524 | A1 | * | 11/2001 | Anderson | 283/81 |

* cited by examiner

*Primary Examiner*—Gary C. Hoge

(57) ABSTRACT

A label display system includes a foldable label base to display labels, such as regulatory and/or certification marking labels, for an electronic and/or portable computing device. The foldable label base moves between a first position and a second position, where the labels are viewable in the first position, and where at least some of the labels are concealed from view in the second position. The foldable label base includes a first side to display labels and a second side to display labels.

48 Claims, 3 Drawing Sheets

FOLDABLE LABEL DISPLAY SYSTEM

TECHNICAL FIELD

This invention relates to electronic devices and, in particular, to displaying regulatory, certification marking, required, and/or information labels on portable electronic and computing devices.

BACKGROUND

The advances and convergence of computer and communication technologies has led to increased regulation, standardization, and testing and certification requirements for electronic and computing devices to ensure that the many available devices from various manufacturers do in fact communicate with each other and are technologically compatible. Standardization, along with testing and certification, ensures the interoperability of the many devices, guarantees the reliability of the devices and the technology, and prevents interference with other communication technologies.

Many countries that import electronic and computing devices require that various regulatory and certifying marks are attached to the devices before they can be shipped into their country. Several well-known independent organizations offer product testing, inspection, and conformity assessments for regulatory and certification approval. Such organizations that evaluate electronic and computing devices include Underwriters Laboratories Inc. (UL), CSA International, and the Nemko Group. CSA and UL are the predominate certification marks for electronic devices in the United States and Canada, and Nemko provides certification marks for Asian and European markets.

Underwriters Laboratories Inc., for example, has at least ten different electronic certifying marks, each having its own specific meaning and significance. The many variations of the UL mark (which is a "UL" enclosed in a circle) is commonly displayed on electrical and electronic devices, and on computer equipment. One such certifying mark associated with the convergence of computer and communication technologies is the international "emc-Mark" which appears on products meeting the electromagnetic compatibility requirements of Europe, the United States, Japan, Australia, or any combination of the four. In the United States, some types of products cannot be sold without proof of compliance to U.S. electromagnetic compatibility requirements. Such requirements include an electronic device's ability to operate in an electric environment without interfering with other electronic devices (emissions), and without being interfered by other devices in its vicinity (immunity). The types of products that are subject to EMC testing include computers, transmitters, and RF (radio frequency) components.

Limited space to display the many regulatory and certification markings, which are typically in the form of stick-on labels, is particularly a problem with portable computing devices such as a laptop computer or a PDA (personal digital assistant) where the physical size of the device limits the space needed to affix the labels to the devices. The number of required regulatory and certification markings continues to increase for wireless communications technologies such as RF (radio frequency), IR (infrared), Bluetooth, and IEEE specification 802.11. Bluetooth and specification 802.11 are examples of short-range wireless communication technologies that are integrated with computing devices.

In addition to the regulatory and certification markings, other information labels are also affixed to electronic and computing devices, such as barcodes, serial numbers, and similar product and/or component identifiers. The requirements to display these additional labels only exacerbate the problem of device exterior housing space limits for such labels. The following description discusses systems and methods to provide space to attach the ever increasing number of regulatory, certification marking, required, and/or identifier labels to electronic and computing devices when constrained to a limited space, such as with a portable computing device.

SUMMARY

A label display system includes a foldable label base to display labels, such as regulatory and/or certification marking labels, for an electronic and/or portable computing device. The foldable label base moves between a first position and a second position, where the labels are viewable in the first position, and where at least some of the labels are concealed from view in the second position.

The foldable label base includes a first side to display labels and a second side to display labels. The foldable label base attaches to the electronic and/or portable computing device and can include a label display cover to engage the electronic and/or portable computing device to secure the foldable label base in the second position.

BRIEF DESCRIPTION OF THE DRAWINGS

The same numbers are used throughout the drawings to reference like features and components.

DETAILED DESCRIPTION

Introduction

The following describes systems and methods for a foldable label display system to display regulatory, certification marking, required, and/or information labels associated with portable electronic and computing devices. In many instances, such labels are required to evidence conformity with standardization and testing requirements. Required labels can include those required by federal or state statute, those required by statute to preserve particular rights, such as a copyright, those required as evidence of testing and standardization, and any other such labels required by a particular country for import/export purposes. The label display system provides otherwise unavailable space to affix, or otherwise attach, these many labels to the devices.

In the described embodiments, an electronic device requiring the regulatory, certification marking, required, and/or information labels is illustrated and described as a portable computing device. However, aspects of the foldable label display system are applicable to other types of devices such as appliances, desktop computers, printers, and the many different types of mobile computing devices of varying sizes and designations. Such mobile computing devices include laptop computers, handheld computers, notebook computers, palm-sized computers, pocket computers, personal digital assistants, personal organizers, portable printers, and the like.

Although the context of this disclosure describes a portable computing device, aspects of the label display system are applicable to electronic and computing devices in general. The specific examples described in this disclosure are not meant to limit the scope of the claims or the description, but are meant to provide a specific understanding of the described implementations.

Exemplary Portable Computing Device

Figure 1:
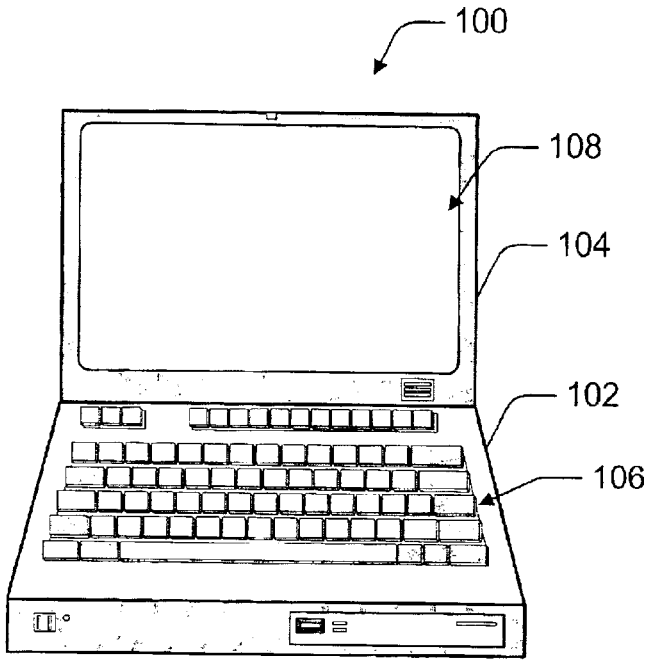
FIG. 1 illustrates a front-view of a portable computing device.

FIG. 1 illustrates a computing device 100, embodied in the form of a portable computer having a housing base 102 and a housing top 104. Housing base 102 and housing top 104 are coupled together via a hinge or other flexible joint (not shown) to permit housing top 104 to fold down over housing base 102. A keyboard assembly 106 is mounted within housing base 102 and a flat panel display 108 is mounted within housing top 104.

Exemplary Computer Architecture

Figure 2:
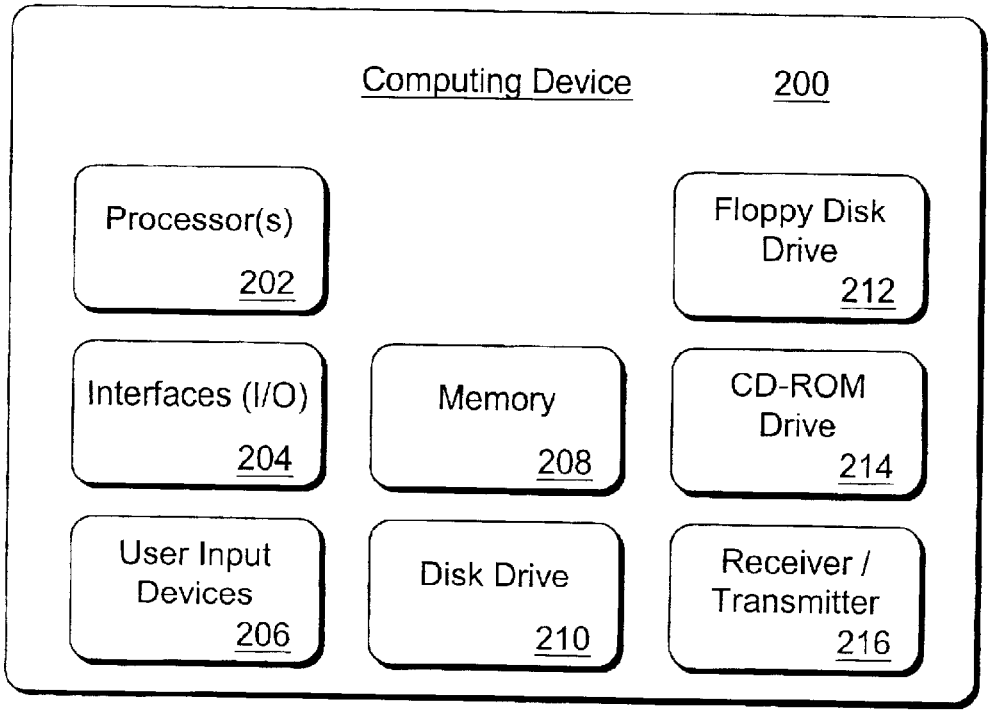
FIG. 2 is block diagram that illustrates various components of an exemplary computing device.

FIG. 2 illustrates various components of an exemplary computing device 200 that can be implemented as portable computing device 100 (FIG. 1). Computing device 200 includes one or more processors 202, interfaces 204 for inputting and outputting data, and user input devices 206. Processor(s) 202 process various instructions to control the operation of computing device 200, while interfaces 204 provide a mechanism for computing device 200 to communicate with other electronic and computing devices. User input devices 206 include a keyboard, mouse, pointing device, or other mechanisms for interacting with, and inputting information to computer 200.

Computing device 200 also includes a memory 208 (such as ROM and/or RAM), a disk drive 210, a floppy disk drive 212, and a CD-ROM drive 214. Memory 208, disk drive 210, floppy disk drive 212, and CD-ROM drive 214 provide data storage mechanisms for computing device 200. Although not shown, a system bus typically communicatively links the various components.

Computing device 200 also includes a receiver and/or transmitter 216 to communicatively link computing device 200 with other electronic and computing devices via a wireless communication link. Receiver and/or transmitter 216 can be configured for wireless communications technologies such as RF (radio frequency), IR (infrared), Bluetooth, and IEEE specification 802.11. For example, receiver and/or transmitter 216 can be implemented as a Bluetooth transceiver that both transmits and receives data.

Exemplary Foldable Label Display System

Figure 3:
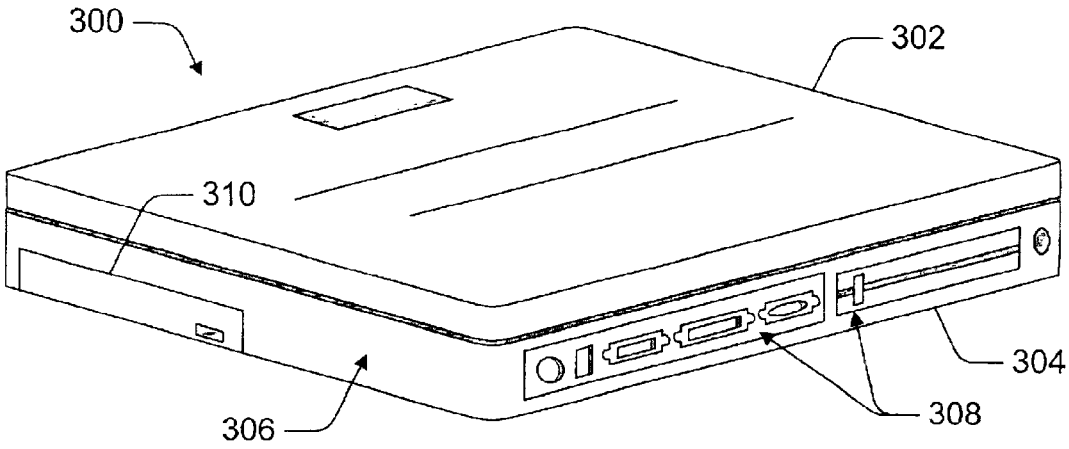
FIG. 3 illustrates a rear-view of a portable computing device.

FIG. 3 illustrates a portable computing device 300 with a housing top 302 folded down over a housing base 304. Computing device 300 is an example of a device that has very little available external housing space 306 to display regulatory, certification marking, required, and/or information labels (all commonly referred to herein as "labels") associated with the device. For example, computing device 300 includes various input/output interface modules 308 having various input/output connectors, and a component access compartment 310 for such components as a disk drive, CD-ROM drive, or batteries to power the device.

These, and other computing device components, limit the available external housing space 306 to affix, or otherwise attach, the labels which are typically stick-on labels. Other limitations and/or concerns with the increasing number of required regulatory, certification marking, required, and/or information labels is the cluttered appearance of the many labels on the device, and the space having to be allocated for the labels that would otherwise be utilized as grip areas for user convenience, and to vent heat generated by internal components of the device to an external of the device.

Figure 4:
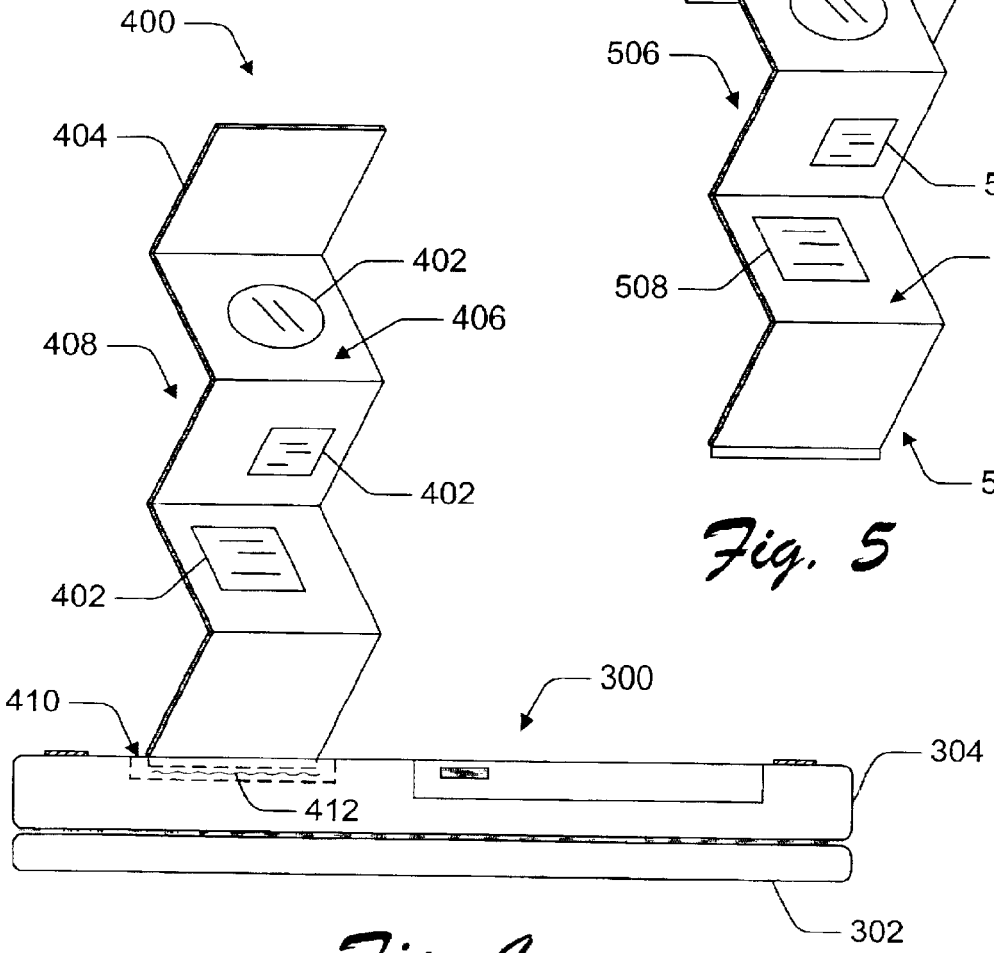
FIG. 4 illustrates a portable computing device with a foldable label display system.

FIG. 4 illustrates computing device 300 (shown up-side down) with a label display system 400 that provides otherwise unavailable space to affix, or otherwise attach, labels 402 to the device. Label display system 400 has a foldable label base 404 which has two sides 406 and 408. The first side 406 is shown as the front of foldable label base 404, and the second side 408 is shown as the back of foldable label base 404. Labels 402 can be affixed to both the first side 406 and the second side 408.

Foldable label base 404 is collapsible into a recess 410 in computing device housing base 304, and expandable out of the recess 410. In an expanded position, as shown in FIG. 4, labels 402 are viewable on both sides 406 and 408 of foldable label base 404. In a second position, which can be fully or partially collapsed into recess 410, at least some of the labels 402 are concealed from view as the foldable label base 404 is folded over and onto itself.

The foldable label base 404 is permanently attached to the computing device housing base 304, such as with an adhesive 412, or other attachment mechanism. Those skilled in the art will recognize that there are any number of attachment mechanisms that can be utilized to attach the foldable label base to computing device 300. Foldable label base 404 can be constructed from any number of durable materials, such as a hard plastic, Kevlar, metal, polycarbon, Mylar, or similar materials of sufficient durability and having a surface that is suitable for stick-on type labels.

Figure 5:
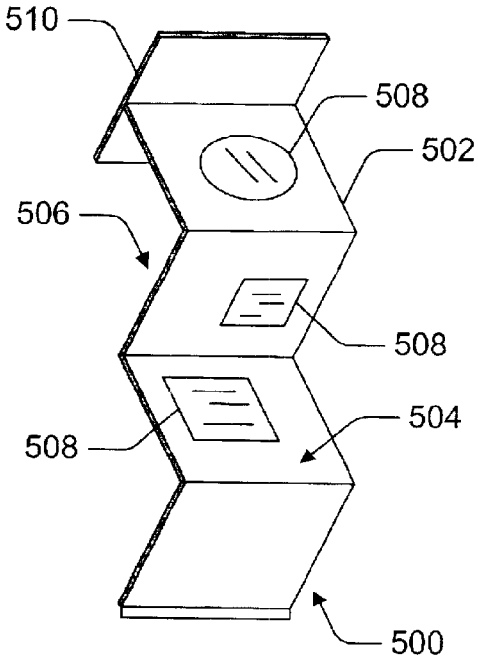
FIG. 5 illustrates a foldable label display system.

FIG. 5 illustrates an alternative label display system 500 having a foldable label base 502 with two sides 504 and 506 to which labels 508 can be affixed or otherwise displayed. Label display system 500 includes a label display cover 510 which is attached to the foldable label base 502. Label display cover 510 engages recess 410 (FIG. 4) and secures the foldable label base 502 when it is collapsed into recess 410.

Methods for a Foldable Label Display System

Figure 6:
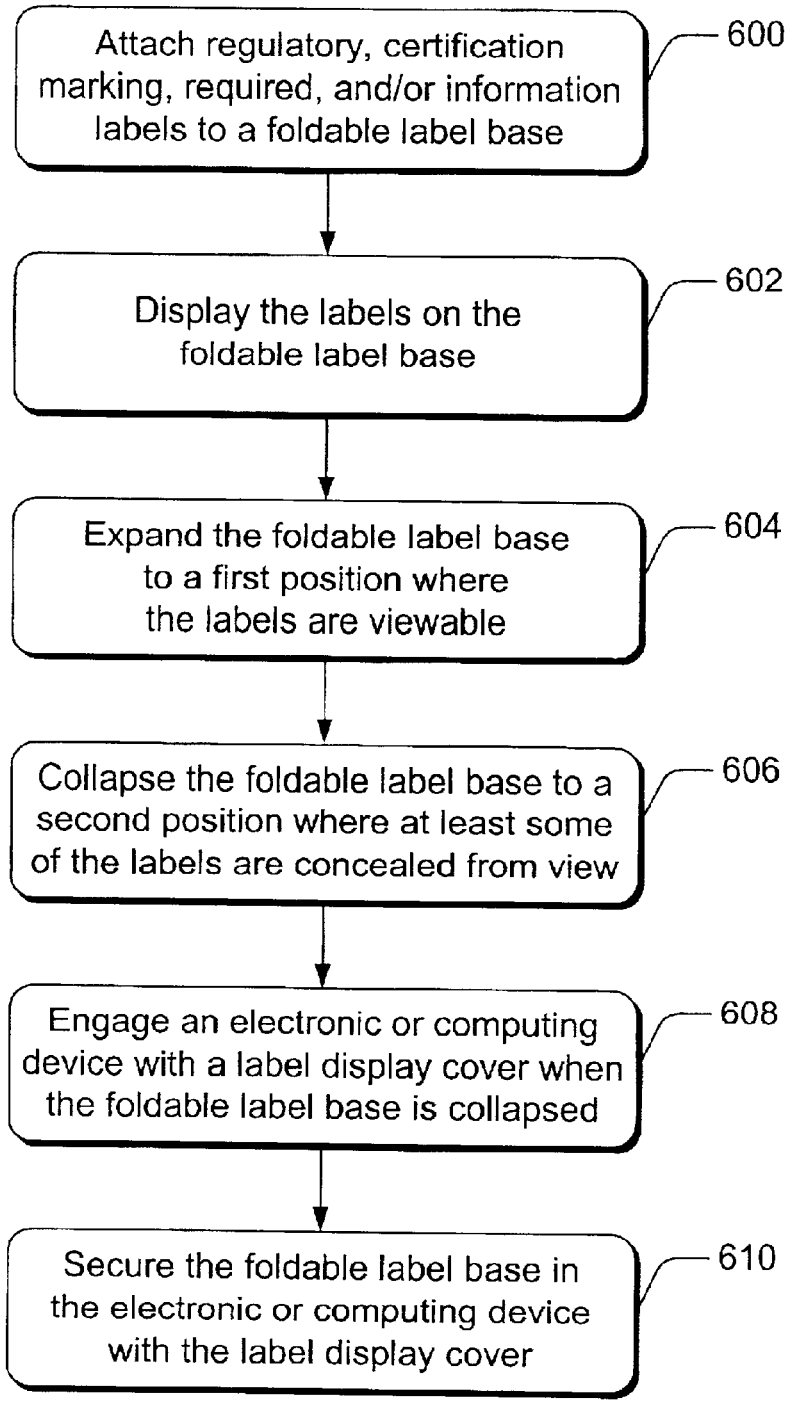
FIG. 6 is a flow diagram that describes a method for a foldable label display system.

FIG. 6 illustrates a method for a foldable label display system. The order in which the method is described is not intended to be construed as a limitation.

At block 600, labels are attached to a foldable label base. The labels can be regulatory, certification marking, required, and/or information labels pertaining to an electronic or computing device. Attaching the labels to the foldable label base includes attaching one or more of the labels to a first side of the foldable label base, and attaching one or more of the labels to a second side of the foldable label base.

At block 602, the labels for the electronic and/or computing device are displayed on the foldable label base. Displaying the labels includes displaying one or more of the labels on a first side of the foldable label base, and displaying one or more of the labels on a second side of the foldable label base.

At block 604, the foldable label base is expanded to a first position where the labels on the multiple sides of the foldable label base are viewable. At block 606, the foldable label base is collapsed to a second position where at least some of the labels are concealed from view.

At block 608, a label display cover engages the electronic or computing device when the foldable label base is collapsed into the second position, and secures the foldable label base in the electronic or computing device at block 610.

Conclusion

A foldable label display system provides space to affix and display regulatory, certification marking, required, and/or information labels associated with electronic and computing devices. The label display system has a foldable label base that can be extended to view the labels, or collapsed from view.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A label display system, comprising:

a foldable label base attached to a portable computing device to display labels for the portable computing device, the foldable label base configured to be unfolded into a first position and folded into a second position, the labels being viewable in the first position and at least some of the labels being concealed from view in the second position; and a label display cover configured to engage the portable computing device and secure the foldable label base in the folded second position into a recess in the portable computing device.

2. A label display system as recited in claim 1, wherein the foldable label base includes a first side to display one or more of the labels and a second side to display one or more of the labels.

3. A label display system as recited in claim 1, wherein the foldable label base is configured to display regulatory labels.

4. A label display system as recited in claim 1, wherein the foldable label base is configured to display certification marking labels.

5. A label display system as recited in claim 1, wherein the foldable label base is permanently attached to the portable computing device.

6. A label display system as recited in claim 1, wherein the foldable label base is collapsible into the second position.

7. A label display system as recited in claim 1, wherein the foldable label base is collapsible into the recess in the portable computing device.

8. A label display system as recited in claim 1, wherein the foldable label base is expandable to the first position.

9. A label display system, comprising:

a foldable label base attached to an electronic device to display required labels for the electronic device, the foldable label base configured to be unfolded into a first position and folded into a second position, the required labels being viewable in the first position and at least some of the required labels being concealed from view in the second position; and label display cover configured to engage the electronic device and secure the foldable label base in the folded second position.

10. A label display system as recited in claim 9, wherein the foldable label base includes a first side to display one or more of the required labels and a second side to display one or more of the required labels.

11. A label display system as recited in claim 9, wherein the foldable label base is configured to display regulatory labels.

12. A label display system as recited in claim 9, wherein the foldable label base is configured to display certification marking labels.

13. A label display system as recited in claim 9, wherein the foldable label base is permanently attached to the electronic device.

14. A label display system as recited in claim 9, wherein the foldable label base is collapsible into the second position.

15. A label display system as recited in claim 9, wherein the foldable label base is collapsible into a recess in the electronic device.

16. A label display system as recited in claim 9, wherein the foldable label base is expandable to the first position.

17. A label display system as recited in claim 9, wherein the label display cover is further configured to secure the foldable label base into a recess in the electronic device.

18. A method, comprising:

attaching labels for a portable computing device to a foldable label base; the foldable label base being moveable between a first position and a second position, wherein the labels are viewable in the first position and at least some of the labels are concealed from view in the second position; and attaching the foldable label base to the portable computing device.

19. A method as recited in claim 18, wherein attaching includes attaching one or more of the labels to a first side of the foldable label base, and attaching one or more of the labels to a second side of the foldable label base.

20. A method as recited in claim 18, wherein attaching includes attaching regulatory labels.

21. A method as recited in claim 18, wherein attaching includes attaching certification marking labels.

22. A method as recited in claim 18, further comprising collapsing the foldable label base into the second position.

23. A method as recited in claim 18, further comprising collapsing the foldable label base into a recess in the portable computing device.

24. A method as recited in claim 18, further comprising expanding the foldable label base into the first position.

25. A method as recited in claim 18, further comprising engaging the portable computing device with a label display cover, and securing the foldable label base in the second position.

26. A method as recited in claim 18, further comprising collapsing the foldable label base into the second position, and engaging the portable computing device with a label display cover to secure the foldable label base in the second position.

27. A method, comprising:

displaying required labels for an electronic device on a foldable label base;

the foldable label base being moveable between a first position and a second position, wherein the required labels are displayed in the first postion and at least some of the required labels are concealed from display in the second position; and attaching the foldable label base to the electronic device.

28. A method as recited in claim 27, wherein displaying includes displaying one or more of the required labels on a first side of the foldable label base, and displaying one or more of the required labels on a second side of the foldable label base.

29. A method as recited in claim 27, wherein displaying includes displaying regulatory labels.

30. A method as recited in claim 27, wherein displaying includes displaying certification marking labels.

31. A method as recited in claim 27, further comprising collapsing the foldable label base into the second position.

32. A method as recited in claim 27, further comprising collapsing the foldable label base into a recess in the electronic device.

33. A method as recited in claim 27, further comprising expanding the foldable label base into the first position.

34. A method as recited in claim 27, further comprising engaging the electronic device with a label display cover, and securing the foldable label base in the second position.

35. A method as recited in claim 27, further comprising collapsing the foldable label base into the second position, and engaging the electronic device with a label display cover to secure the foldable label base in the second position.

36. A portable computing device, comprising:

a label display system attached to the portable computing device to display labels, the label display system configured to be unfolded such that the labels are viewable and further configured to be folded such that at least some of the labels are concealed from view; and a recess in the portable computing device configured to house the label display system when folded.

37. A portable computing device as recited in claim 36, further comprising a label display cover configured to engage the recess and secure the label display system in the recess.

38. A portable computing device as recited in claim 36, wherein the label display system includes a label display cover configured to engage the recess and secure the label display system in the recess.

39. A portable computing device as recited in claim 36, wherein the label display system includes a first side to display one or more of the labels and a second side to display one or more of the labels.

40. A portable computing device as recited in claim 36, wherein the label display system is further configured to display regulatory labels and certification marking labels.

41. A portable computing device as recited in claim 36, wherein the label display system is collapsible when folded.

42. A portable computing device as recited in claim 36, wherein the label display system is expandable when unfolded.

43. An electronic device, comprising:

a foldable label base attached to the electronic device to display labels, the foldable label base configured to be unfolded such that the labels are viewable and further configured to be folded such that at least some of the labels are concealed from view; and a recess in the electronic device configured to house the foldable label base when folded.

44. An electronic device as recited in claim 43, wherein the foldable label base includes a label display cover configured to engage the recess and secure the foldable label base in the recess.

45. An electronic device as recited in claim 43, wherein a section of the foldable label base functions as a label display cover configured to engage the recess and secure the foldable label base in the recess.

46. An electronic device as recited in claim 43, wherein the foldable label base includes a first side to display one or more of the labels and a second side to display one or more of the labels.

47. An electronic device as recited in claim 43, wherein the foldable label base is further configured to display regulatory labels and certification marking labels.

48. An electronic device as recited in claim 43, wherein the label display system is collapsible when folded and expandable when unfolded.

* * * * *